US009517377B2

(12) United States Patent
Villella

(10) Patent No.: US 9,517,377 B2
(45) Date of Patent: Dec. 13, 2016

(54) EXERCISE BAR

(71) Applicant: Giacomo Villella, Niagara Falls (CA)

(72) Inventor: Giacomo Villella, Niagara Falls (CA)

( * ) Notice: Subject to any disclaimer, the term of this patent is extended or adjusted under 35 U.S.C. 154(b) by 0 days.

(21) Appl. No.: 14/271,004

(22) Filed: May 6, 2014

(65) Prior Publication Data

US 2014/0336019 A1 Nov. 13, 2014

(30) Foreign Application Priority Data

May 7, 2013 (CA) ..... 2816146

(51) Int. Cl.

| | |
|---|---|
| ***A63B 21/072*** | (2006.01) |
| ***A63B 21/00*** | (2006.01) |
| ***A63B 23/02*** | (2006.01) |
| *A63B 21/068* | (2006.01) |
| *A63B 23/00* | (2006.01) |

(52) U.S. Cl.

CPC ..... *A63B 21/072* (2013.01); *A63B 21/0004* (2013.01); *A63B 21/0724* (2013.01); *A63B 23/0211* (2013.01); *A63B 21/068* (2013.01); *A63B 21/4035* (2015.10); *A63B 2023/006* (2013.01)

(58) Field of Classification Search

CPC ..... A63B 15/00; A63B 15/005; A63B 21/072; A63B 21/0722; A63B 21/0724; A63B 21/0726; A63B 21/075; A63B 2021/0722; A63B 21/0004; A63B 21/4035; A63B 23/1281; A63B 23/14

USPC ..... 482/38–42, 44–50, 91–93, 106–109

See application file for complete search history.

(56) References Cited

U.S. PATENT DOCUMENTS

| | | | | |
|---|---|---|---|---|
| 1,714,391 | A | 5/1927 | McWhirter | |
| 3,637,205 | A | 1/1972 | Bankston | |
| 3,716,232 | A * | 2/1973 | Johnson et al. | 482/40 |
| 3,820,781 | A | 6/1974 | Kane | |
| 3,942,790 | A | 3/1976 | Rice | |
| 4,440,391 | A | 4/1984 | Saenz, Jr. et al. | |
| 4,518,162 | A | 5/1985 | Oates | |

(Continued)

FOREIGN PATENT DOCUMENTS

| | | |
|---|---|---|
| CA | 2019248 | 12/1991 |
| EP | 1338308 A1 | 8/2003 |

OTHER PUBLICATIONS

Canadian Patent Application No. 2,816,146, Office Action dated Oct. 15, 2014.

*Primary Examiner* — Oren Ginsberg
*Assistant Examiner* — Gregory Winter
(74) *Attorney, Agent, or Firm* — Borden Ladner Gervais LLP; Shin Hung

(57) ABSTRACT

An exercise bar having a cross sectional shape in the form of an octagon, and composed of a longitudinal body with stabilizer ends attached to the ends thereof. The longitudinal body has a central axis constant through its length, and can be manufactured with materials such as hard woods, plastic, certain metals, sponge rubber, or any resilient material which resists bending or deflection when used in specific exercises. The material can be selected to be lightweight to ensure persons of any strength level can use the exercise bar. The stabilizer ends are secured to the ends of the longitudinal body, and can be any type of rubber material or material that grips a smooth surface, such as laminated wood flooring, to prevent slippage of the longitudinal body.

13 Claims, 18 Drawing Sheets

(56) References Cited

U.S. PATENT DOCUMENTS

| | | | | |
|---|---|---|---|---|
| 4,664,373 | A | 5/1987 | Hait | |
| 4,682,774 | A | 7/1987 | Holy | |
| 5,029,847 | A | 7/1991 | Ross | |
| 5,312,314 | A | 5/1994 | Stephan et al. | |
| 5,328,431 | A | 7/1994 | Winslow | |
| 5,403,256 | A * | 4/1995 | Squires | A63B 9/00 482/148 |
| 5,588,942 | A * | 12/1996 | Dillard | 482/139 |
| 6,196,921 | B1 | 3/2001 | Larson | |
| 6,599,222 | B2 * | 7/2003 | Wince | 482/106 |
| 7,951,051 | B1 * | 5/2011 | Brown | A63B 21/0004 482/111 |
| 2007/0135275 | A1 * | 6/2007 | Oates | 482/109 |
| 2007/0167298 | A1 | 7/2007 | Bystrom | |
| 2007/0275834 | A1 * | 11/2007 | Reilly | A63B 15/00 482/91 |
| 2011/0152044 | A1 * | 6/2011 | Klein | A63B 21/026 482/110 |
| 2012/0302409 | A1 * | 11/2012 | Mikulski | 482/93 |
| 2013/0040786 | A1 * | 2/2013 | Heinrich | 482/81 |
| 2015/0297942 | A1 * | 10/2015 | Tully | A63B 21/16 482/94 |

* cited by examiner 24
24
24
22
22
22
20
24
24
24

EXERCISE BAR

CROSS REFERENCE TO RELATED APPLICATIONS

This application claims the benefit of priority of Canadian Application No. 2,816,146, filed May 7, 2013, which is hereby incorporated by reference.

FIELD

The present disclosure relates generally to exercise bars.

BACKGROUND OF INVENTION

Exercises with sticks have been known for thousands of years. It is believed that the traditional stick martial art of Silambam originated in South India over 5000 years ago. The bamboo staff, known as the Silambamboo, was used as a weapon and a self-defense tool to ward off wild animals and other attackers. Although the typical length of a Silambamboo is 1.68 m, the height of the staff is sometimes adjusted to be proportionate to the height of its user. The 1-inch diameter of the staff remains the same.

The stick martial art of Silambam found its way to China in 464 by Theravada, Buddhist monk Batuo (Buddhabhadra), which means 'Man with conscience'. Batuo arrived from India and taught Buddhism in China, founding the Shaolin Monastery. His teachings influenced the development of Ch'an Buddhism, which is more commonly known in Japanese as 'Zen'. It is believed that two of Batuo's disciples, who were purportedly martial art experts and may have begun the Shaolin martial art tradition, which continues to use fighting sticks to this day.

There are many other examples of how wooden sticks are utilized as a mode of combat and self-defense. For instance, the art of Filipino stick fighting is mandatory practice for both the police and military in the Philippines. Also, some kung fu and karate practices continue to teach the skills of stick fighting today.

Although it is widely understood that practitioners of stick fighting have to be in peak physical shape, the emphasis on sticks and exercise has traditionally been associated with combat and self-defense. The stick is commonly seen as a tool to strike, block, deflect or evade an opponent. Less emphasis has been placed upon the stick as a method of exercise to achieve greater flexibility, strength, agility, balance and overall well being.

Most noteworthy is Arnold Schwarzenegger who in the 1970's made oblique exercises famous using a stick. He performed torso twists at different angles to increase size and strength to his oblique. In the late eighties the Body Bar became popular creating a whole system of exercises and stretches using a weighted bar at different lengths and weights. The Body Bar ranges from 2 feet and 4 lbs, to 6 feet and 50 lbs. Today Body Bar is a flourished company that spans the globe.

Athletes have used sticks as a means of exercise and stretching for years. At the inception of ice hockey and baseball, pre-game rituals consisted by using their sticks and bats respectively to help prepare and maintain. For example, in the sport of ice hockey, the players skate around during warm-ups resting their sticks on their shoulders while doing torso twists. In baseball, players during warm-ups use multiple bats together and simulate modified swings and motions. Still today in both ice hockey and baseball these rituals exist. Using a stick or an exercise bar while stretching and exercising helps the user control his or her balance and allows for controlled motions during certain body movements and held body positions.

Increasing flexibility through stretching is one of the basic tenets of physical fitness. It is common for athletes to stretch before and after exercise in order to reduce injury and increase performance. Hatha Yoga involves the stretching of major muscle groups, some of which require a high level of flexibility and core strength to perform, for example the lotus position. Stretching can strengthen muscles, and in turn strong muscles are important to stretching safely and effectively.

Today it is known that core exercises are important in promoting a well-rounded health and fitness plan. Core strength, core stabilization, and core support are buzzwords that mean pretty much the same-working abdominals and other postural muscles to help create and maintain ideal alignment. Many rehab clinics and physical therapy offices are now administering core strengthening programs to their back and neck patients.

Physio Therapist, Chiropractors, and Kineseologists are other practitioners that rely on stretching and natural body movements to rehabilitate, and strengthen individuals back to health. The use of the present invention will guide and balance users while performing stretches, body movements, and core strengthening exercises, aiding practitioners and their participants in an overall sense of well being.

Stretching and exercising with a stick has been proven throughout history to be beneficial and an essential part of maintaining health and wellness, but until the present invention no universal stretching and exercise bar/stick which follows basic shapes and patterns with the body to strengthen, stretch and rehabilitate has been devised solely for this purpose in Canada.

Previous attempts have been made to create exercise bars to stretch and exercise with the main focus being on torso twists, with extra weight added to apparatus. Although effective, all other attempts are cylindrical in shape, and fall short on the dynamics of the present invention. Similarities are found in the following patents. U.S. Pat. No. 1,714,391 McWhirter, May 21, 1929, U.S. Pat. No. 3,637,205 Bankston, Jan. 25, 1972, U.S. Pat. No. 3,820,781 Kane, Jun. 28, 1974, U.S. Pat. No. 3,942,790 Rice, Mar. 9, 1976, U.S. Pat. No. 4,440,391 Saenz, Apr. 3, 1984, U.S. Pat. No. 4,518,162 Oates, May 21, 1985, U.S. Pat. No. 4,664,373 Hait, May 12, 1987, U.S. Pat. No. 5,029,847 Ross, Jul. 9, 1991, Canadian patent 2019248 Baker, Dec. 12, 1991, and U.S. Pat. No. 5,328,431 Winslow, Jul. 12, 1994.

SUMMARY OF THE INVENTION

In a first aspect, there is provided a resilient hand held exercise tool having a predetermined length to guide and balance a user through exercises and positions within a square and a circle, where the user's own natural body shape, weight and motion provides resistance to working muscles, for the purposes of increase flexibility, enhancing core strength and to stimulate all parts of the user's body. The resilient hand exercise tool includes an octagon shaped longitudinal body, a first stabilizer end, and a second stabilizer end. The octagon shaped longitudinal body has a central axis and a predetermined diameter, the longitudinal body having a first end and a second end. The first stabilizer end is attached to the first end of the longitudinal body. The second stabilizer end is attached to the second end of the longitudinal body. The first stabilizer end and the second stabilizer end are constructed of a material that minimizes slippage of the longitudinal body when placed on a surface, and a total length of the longitudinal body with the first stabilizer end and the second stabilizer end is equal to the predetermined length.

According to one embodiment of the first aspect, a height of the square is approximately a height of the user, the width of the square is approximately an arm span of the user, and the circle is dimensioned such that the user's arms at full extension with fingertips at the height of the user touch a perimeter of the circle, such that the square, fingertips and circle are in contact with each other. The total length is at least the height of the user, or alternately, the total length is substantially the height of the user. According to another embodiment, the predetermined diameter is sized to allow a hand of the user to encircle the longitudinal body. In particular, the predetermined diameter can be approximately 1.125 inches. In yet a further embodiment of the first aspect, the longitudinal body is coated with a synthetic coating to increase friction with a hand of a user. In the first aspect, the stabilizer end includes an octagon shaped base and a plug extending from the base, the diameter of the base being the same as the diameter of the longitudinal body such that faces of the base align with faces of the longitudinal body when the stabilizer ends are attached to the longitudinal body. In yet another embodiment, the first end and the second end of the longitudinal body each includes a cavity for receiving plug of the stabilizer ends, the cavity being sized to retain the plug by friction. In particular, the cavity can be threaded, and the plug can have a complementary threading for enabling the stabilizer end to be screwed into the threaded cavity. Furthermore, the base of each stabilizer end can flex relative to the plug to maintain substantially an external surface of the base in contact with a floor surface.

In yet another embodiment of the first aspect, the longitudinal body is composed of three removably attachable segments; a first segment, a second segment and a third segment. The first segment is a center body having first and second octagon shaped, reduced diameter arms extending from respective ends of a main body. The second segment is a first end extension including the first stabilizer end, and includes a hollow sleeve portion shaped to receive one of the reduced diameter arms of the main body. The third segment is a second end extension including the second stabilizer end, and includes a hollow sleeve portion shaped to receive the other of the reduced diameter arms of the main body. In the current embodiment, the reduced diameter arms each include at least one depressible clip plug, and the hollow sleeve portions of each of the second segment and the third segment include at least one hole positioned to receive a respective clip plug. The second segment and the third segment lock with the first segment when the clip plugs engage the holes. The lengths of the second segment and the third segment are identical to each other, or alternately, the lengths of the second segment and the third segment are different from each other.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Figure 1:
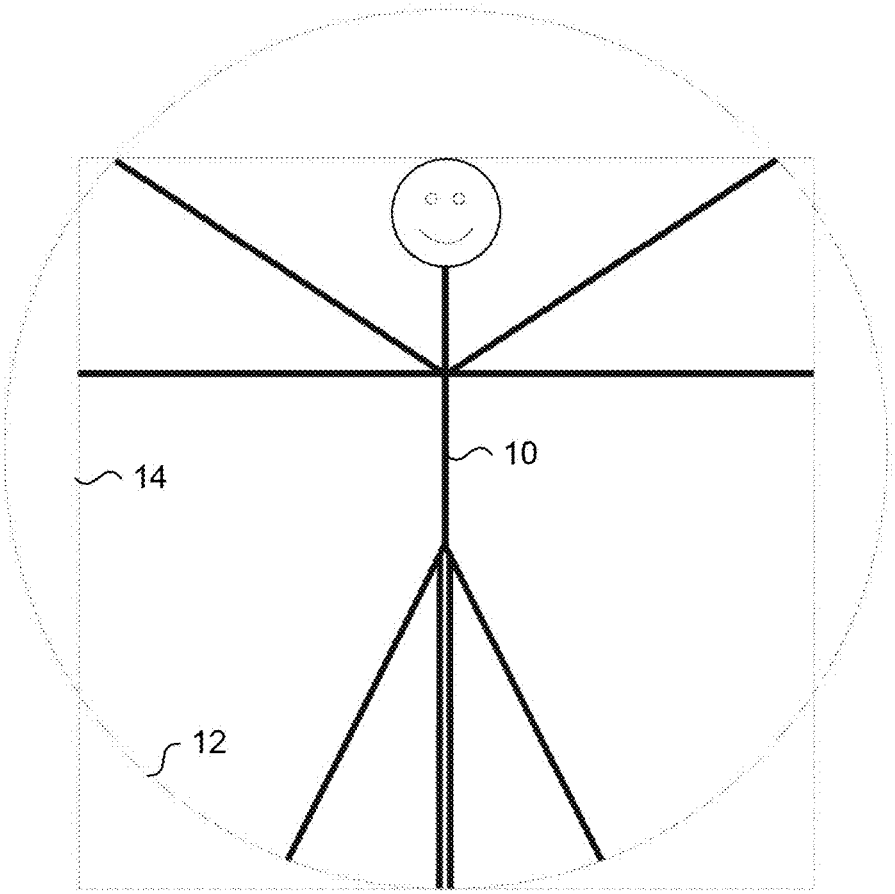
FIG. 1 is a simplified illustration of the Vitruvian Man drawing by Leonardo DaVinci.

The embodiments of the present invention provides an exercising and stretching bar with stabilizer ends and shaped in the form of an octagon with a purpose to stretch, strengthen and rehabilitate. The length, weight, feel, strength, and stabilizing abilities of the invention are pertinent to how it is used. The invention follows the world-renown drawing of The Vitruvian Man by Leonardo DaVinci. The drawing depicts a human body layered in two positions within a circle and square. This image exemplifies perfect proportions of the human body within the square and circle. DaVinci's image is also known as the canon of proportions or the anatomical man and is widely used by health and wellness professionals in fields such as chiropractory, physio thearapy, and holistic practitioners.

Figure 11:
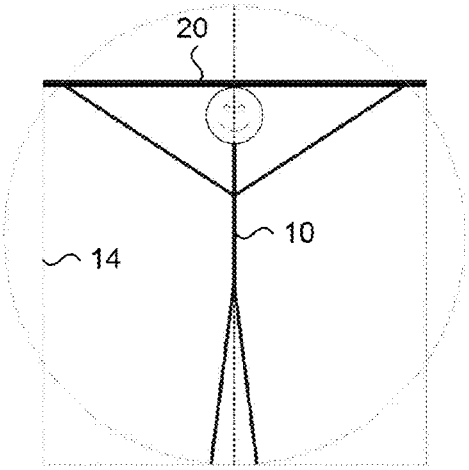
FIGS. 11-20 are illustrations of exercise poses using the exercise bar of the present embodiments.

During exercise and held positions as shown in FIG. 11 by example, balancing the pose while maintaining the exercise bar vertical requires great strength from the entire body as the exercise bar becomes a point of contact in the base of support of the position, causing the entire body from hands to feet to resist the force of gravity and maintain position.

The force of support of the exercise bar is successful in securing the weight of resistance provided by user (gravity) while held with hands.

The embodiments of the present invention provides an exercising and stretching bar with stabilizer ends and shaped in the form of an octagon with a purpose to stretch, strengthen and rehabilitate. The length, weight, feel, strength, and stabilizing abilities of the exercise bar are pertinent to how it is used. The embodiments of the exercise bar are based on the world-renown drawing of The Vitruvian Man by Leonardo DaVinci. FIG. 1 is a simplified illustration of the Vitruvian Man drawing by Leonardo DaVinci. The illustration of FIG. 1 depicts a human body 10 layered in two positions within a circle 12 and square 14. This image exemplifies perfect proportions of the human body within the square 14 and circle 12. DaVinci's image is also known as the canon of proportions or the anatomical man and is widely used by health and wellness professionals in fields such as chiropractory, physio thearapy, and holistic practitioners.

FIG. 1 illustrates that the height of the human body is the exact height of the square 14, and the arm span of the human body from fingertip to fingertip is the exact width of the square 14. When arms at full extension and fingertips are at the same height of the body (top of square) the fingertip stays on the perimeter of the circle 12 and at this point the square 14, fingertip, and circle 12 come into contact.

Figure 2:
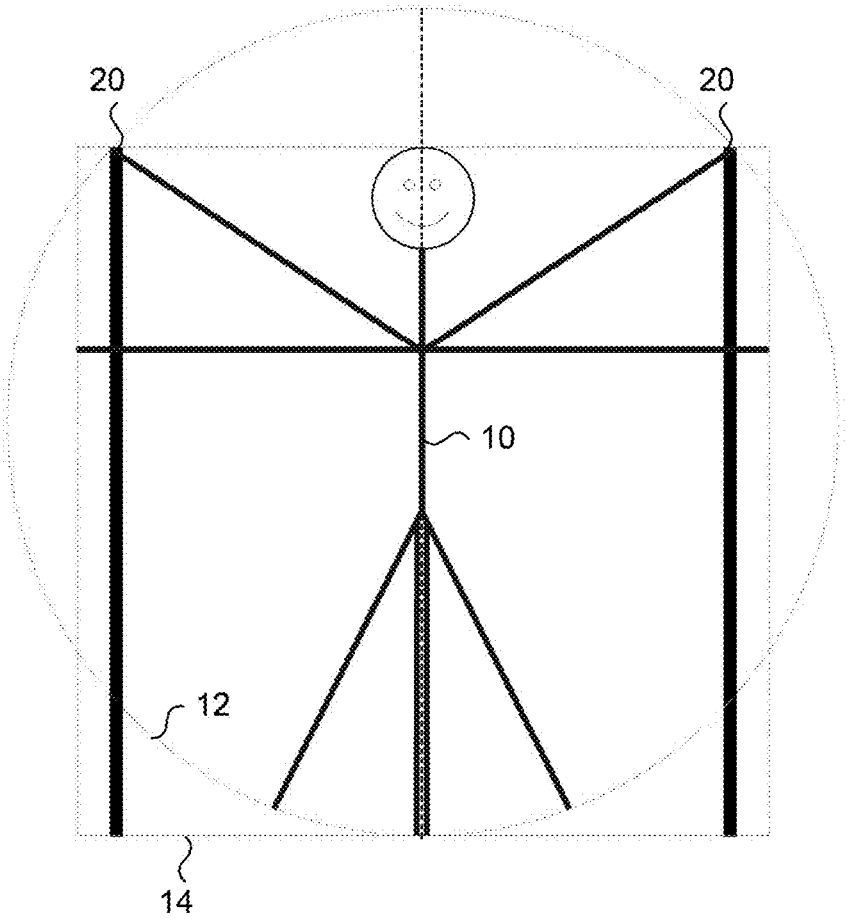
FIG. 2 is an illustration of the simplified Vitruvian Man drawing of FIG. 1, with an embodiment of the exercise bar according to a present embodiment.

FIG. 2 is an illustration of the simplified Vitruvian Man drawing of FIG. 1, with an embodiment of the exercise bar 20. In FIG. 2, two exercise bars 20 are each positioned vertically with their bottoms aligned with a bottom edge of square 14. In this orientation, the exercise bar 20 length has to be equal to or greater than the height of the body 10 while standing erect, and the center of gravity passes from the pit of throat through the umbilicus and pubis between legs, to allow body to extend extremities to maximum within the square 14 and the circle 12.

The point where the outstretched fingertip, the straight line of the square 14 and the curved line of the circle 12 make contact can be the same as the total length of exercise bar 20. Also it illustrates that the exercise bar 20 to achieve maximum results within the square 14 and the circle 12, should be equal to or greater than the height of the user 10. Following is a description of the exercise bar 20.

Figure 3:
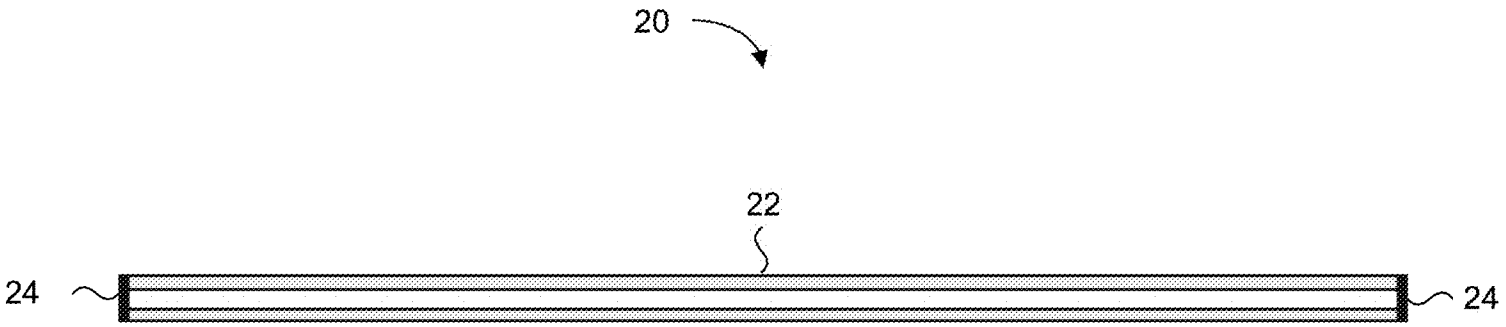
FIG. 3 is a side view of the exercise bar, according to a present embodiment.

FIG. 3 illustrates one embodiment of the invention, shown in plain view. Exercise bar 20 has a cross sectional shape in the form of an octagon, and is composed of a longitudinal body 22 with stabilizer ends 24 attached to the ends thereof. The longitudinal body has a central axis constant through its length. The longitudinal body 22 can be manufactured with materials such as hard woods, plastic, certain metals, sponge rubber, or any resilient material which resists bending or deflection when used in specific exercises. The material can be selected to be lightweight to ensure persons of any strength level can use the exercise bar 20. The stabilizer ends 24 are secured to the ends of the longitudinal body 22, and can be any type of rubber material or material that grips a smooth surface, such as laminated wood flooring, to prevent slippage of the longitudinal body 22. In the present embodiment, the body 22 is of unitary construction, or a single piece of material. The body 22 can be solid throughout, or hollow without sacrificing strength of the body 22. In combination, the longitudinal body 22 and stabilizer ends 24 provides adequate strength, elasticity, and traction to perform the stretches and exercises it is intended for. From this point forward, the longitudinal body 22 is simply referred to as the body 22.

In one embodiment, the body 22 can be painted or covered with a synthetic rubber coating, which allows for grip and handling comfort by the user. In the present embodiments, the body 22 has an octagon shape. The octagon shape attributes to feel while held, as the ridges where the faces of the octagon meet on the body 22 act as points of reference for hands while providing some level of tactile feedback. The exercise bar 20 embodiments can thus be used as a massage roller for tight and sore muscles, and the lines/ridges on the body 22 work as pressure points, which will allow for increased isolation to parts of the body.

As previously discussed, the total length of the exercise bar 20 (with stabilizer ends 24) preferably has a length equal to the height of the user. Therefore, the exercise bar 20 can be manufactured to have different lengths. It is noted however, that certain lengths will be sufficient for a range of person heights. In one example, the exercise bar 20 can be provided in lengths of between 5 feet to 8 feet, all having a 1.125 inch diameter. The diameter refers to the smallest circle that encloses the points of the octagon. While the diameter can be 1.125 inches, any diameter sized to allow a user's hand to comfortably encircle the longitudinal body are possible, as different users have different hand sizes. The length of the exercise bar for a user is determined by the height of user. For example if the user is 5 feet and 9 inches tall, a 6-foot exercise bar (72 inch) is the preferred size. The exercise bar 20 should be at least the height of the user to achieve the full range of positions and exercises it is intended for.

Figure 4:
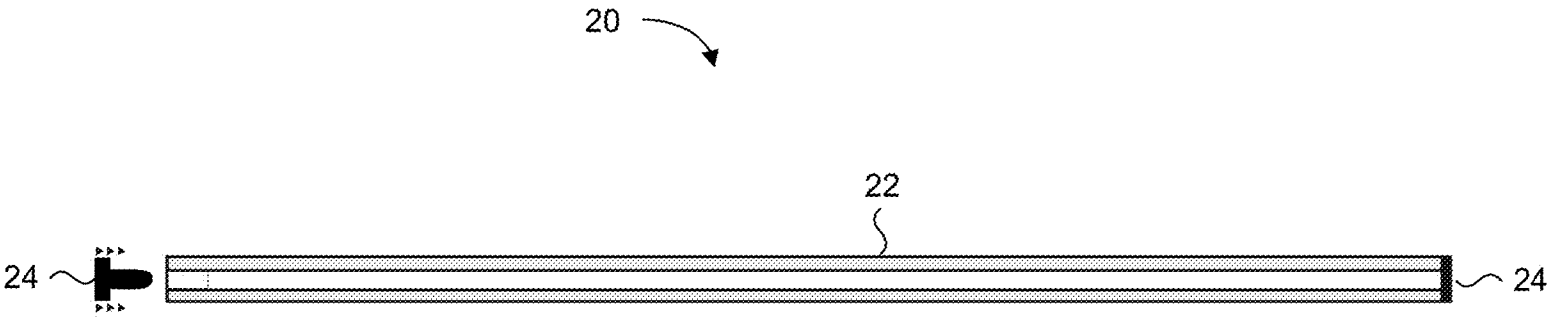
FIG. 4 is a partially exploded view of an end of the exercise bar of FIG. 1.

FIG. 4 is a partially exploded view of the left end of the exercise bar 22. On the left side of FIG. 4, the stabilizer end 24 is shaped to have a male end for insertion into a complementary shaped female end of the body 22. The arrows shown in FIG. 4 illustrate the direction of insertion of the stabilizer end 24 into the end of the body 24, while the opposite end of body 22 has the stabilizer end already inserted and secured in place. The stabilizer end 24 can be replaced if it becomes worn out due to extensive use, and is therefore removable.

Figure 5:
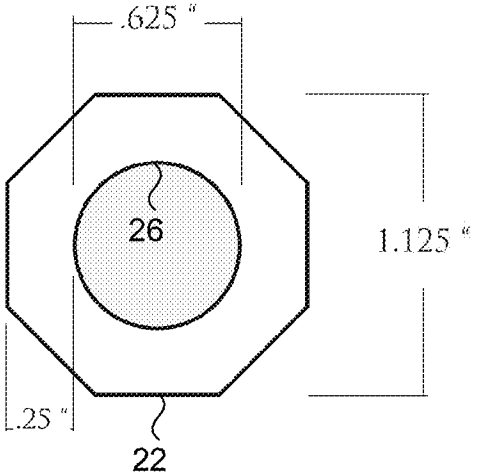
FIG. 5 is an end view of the exercise bar, without the stabilizer end.

FIG. 5 is an end view of exercise bar 20, without the stabilizer end. It is clear from this view that the body 22 is octagon in shape. Shown in FIG. 5 is a cylindrical cavity 26, configured for receiving the stabilizer end. In the present example, the diameter of the circle opening is 0.625 inches and the depth of the cavity, or hole, is 1.125 inches. In this example, the height and width of the octagon is 1.125 inches and the distance from the outer perimeter of circle and the inner perimeter of the octagon is 0.25 inches. These are example dimensions only, and different dimensions can be used in alternate embodiments. In the present embodiment of FIG. 5, the walls of cylindrical cavity 26 can be relatively smooth, and the stabilizer end can have a diameter slightly larger than the diameter of cylindrical cavity 26. Since the stabilizer end can be made of rubber material, it can be squeezed into cavity 26 and retained by friction alone.

Figure 6:
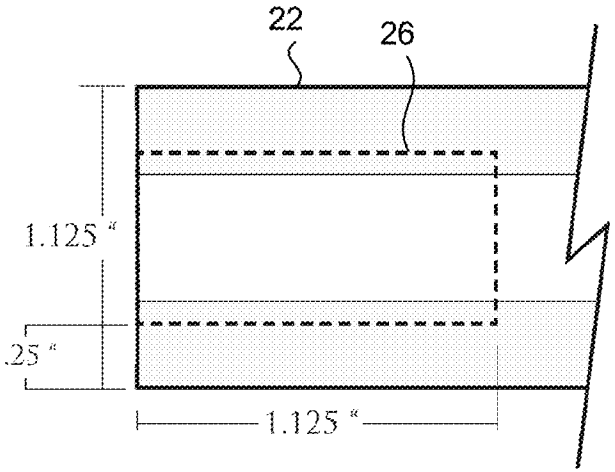
FIG. 6 is a side view of an end of the exercise bar body, without the stabilizer end.

FIG. 6 is a side view of an end of body 22 without the stabilizer end. The dotted line 28 shows the location of the cylindrical cavity 26. It is noted that the depth of the cylindrical cavity 26 can be greater than the plug portion of the stabilizer end.

Figure 7:
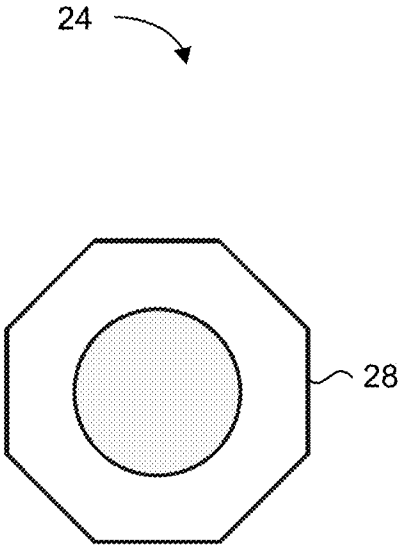
FIG. 7 is a top view of the stabilizer end, according to a present embodiment.

FIG. 7 is a top view of the stabilizer end 24, according to a present embodiment. The stabilizer end 24 can be manufactured from a dense sponge rubber that has non-marking and non-slipping characteristics. It is noted that the base 28 is octagon in shape and dimensioned to be the same as body 22. When the faces of base 28 are aligned with body 22, a uniform appearance is of the exercise bar 20 is provided. In alternate embodiments, the base 28 can have a smaller diameter than the body, or can have a different non-octagon shape altogether. While not clearly shown in FIG. 7, a plug extends from the base, and is sized and shaped to mate with the cylindrical cavity 26.

Figure 8:
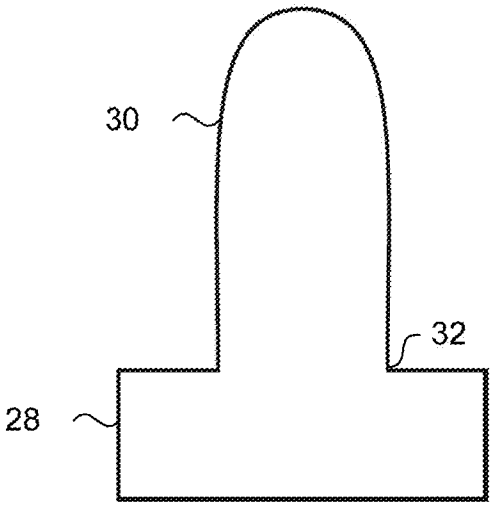
FIG. 8 is a side view of the stabilizer end, according to a present embodiment.

FIG. 8 is a side view of the stabilizer end 24, which clearly shows the base 28 and the plug 30 extending from the base. In the present embodiment, the plug 30 is centered on the base 28. According to a present embodiment the stabilizer end 24 is constructed of a malleable material, such as rubber for instance. Accordingly, the horizontal interface 32 where the base 28 meets the plug 30 is flexible and allows the base 28 to flex and bend about the plug 30, and vice versa.

Figure 9:
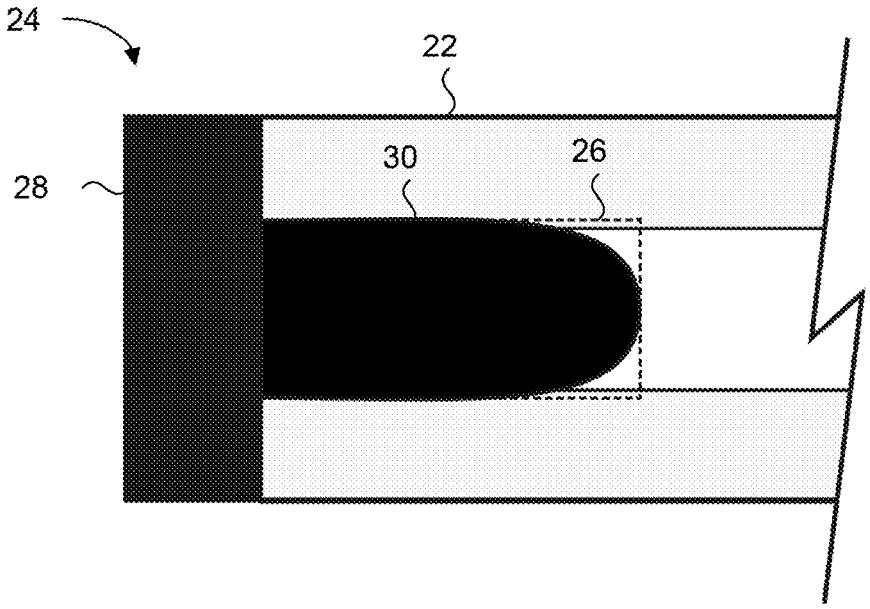
FIG. 9 is a cutaway side view of an end of the body with inserted stabilizer end.

FIG. 9 is a cutaway side view of an end of the body 22 with inserted stabilizer end 24. As shown in FIG. 9, the entirety of the plug 30 fits into the cylindrical cavity 26 leaving the base 28 exposed at the end of the body 22. The plug 30 or cavity 26 can be coated in glue or some other adhesive if desired. It is noted that the plug 30 is secured to the cavity so that it does not unintentionally slip out during use. However, the base 28 is not fixed or attached to the face of the longitudinal body end. The purpose of this will be described and shown in further detail later.

Figure 10:
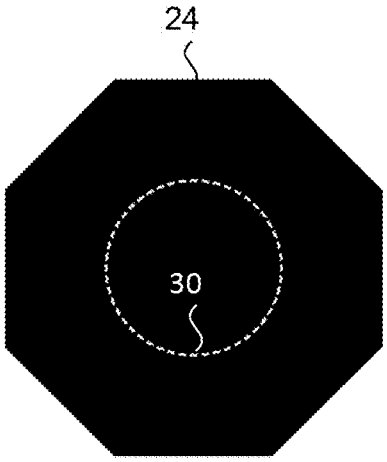
FIG. 10 is a bottom face view of the stabilizer end.

FIG. 10 is a bottom face view of the stabilizer end 24. More specifically, this view shows the end as it would be inserted into the body 22 of the exercise bar 20. The dotted circle represents the diameter of the plug 30 which extends into the page of the drawing. In the present example, the diameter of the dotted circle is 0.625 inches and resembles the 1.125 inches of the rubber stabilizer inside the cylindrical cavity 26.

The following FIGS. 11 to 20 are example illustrations of exercises using the exercise bar 20 of the present embodiments by a user 10.

FIG. 11 is an illustration of use for the purpose of guiding and balancing while holding on top of the head, emphasizing proper posture and represents the horizontal line of square 14. The center of gravity passes the central line from pit of throat through the umbilicus and pubis between the legs.

Figure 12:
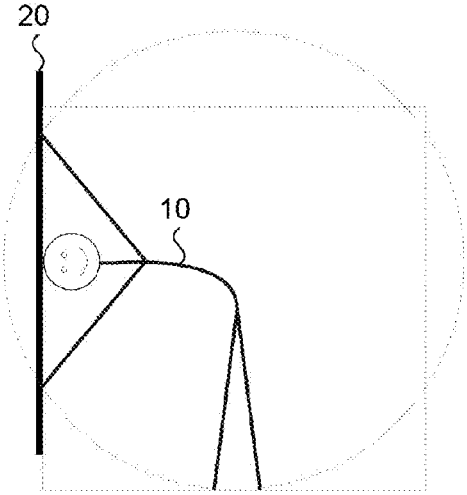

FIG. 12 is an illustration of use for the purpose of guiding and balancing while moving the body 10 from left to right at torso attempting to create a vertical line on either side of body 10. When the body 10 moves to one side, the center of gravity also changes and moves accordingly to the same side, while the opposite side of body 10 resists the forces of gravity, using core and stabilizer muscles. Performing movement and position in front of a mirror will allow user 10 to view the horizontal position (start) of the exercise bar in FIG. 11 to the vertical position (finish) in FIG. 12, and also proper posture.

Figure 13:
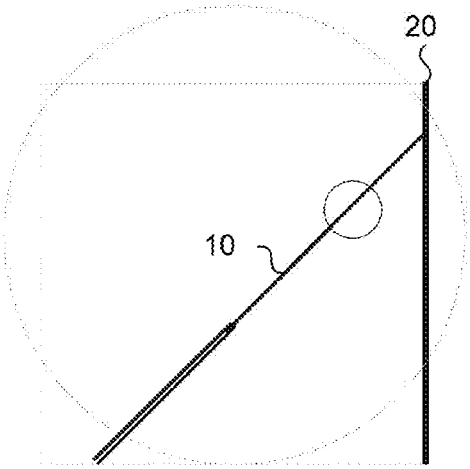

FIG. 13 is an illustration of use for the purpose of vertically supporting as a point of contact in base of support of position while attempting a plank with arms and legs fully extended. The upward force from the points of contact or support forces created from the invention and the feet balance the downward forces of gravity (weight).

This pose can be varied in many ways to increase or decrease the intensity on the body by altering center of gravity. For example one hand holding the exercise bar 20 would make it more difficult than holding it with both hands to balance the pose. Straight arms as opposed to bent arms would be more difficult to hold pose. Hand position on the exercise bar 20 would have an impact on the intensity of the pose; higher easier, lower harder. The resisting force of gravity from the exercise bar 20 is positioned on the holding strength of the hands, which will emphasize upper body strength and specific muscle groups such as, hands, arms, shoulders, back, and chest. All positions however develop strength in core muscles and stabilizer muscles throughout entire body 10.

Figure 14:
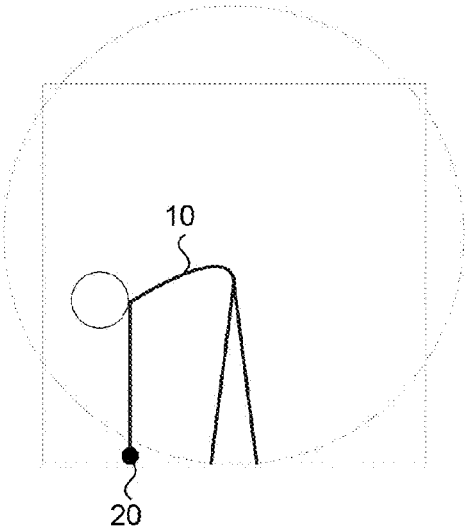

FIG. 14 is an illustration of use for the purpose of guiding, and balancing while performing lower extremity stretches at a 90 degree angle on both left and right side of body. Toes remain forward in position. When the body 10 moves to one side the center of gravity also changes and moves accordingly to the same side, and the opposite side of body 10 has to resist the force of gravity from falling, creating muscular strength in core and stabilizer muscles of the body 10.

Figure 15:
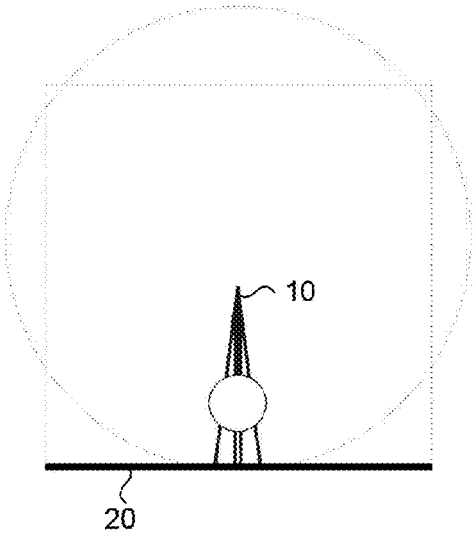

FIG. 15 is an illustration of use for the purpose of guiding, and balancing while performing lower extremity stretches to the front of toes and the back of heals. Creating horizontal lines in front and of back will guide user through progression in poses. For example, when the base of support (feet) is apart and hand position on exercise bar 20 is together, would be easier than if base of support (feet) are together and hands are apart on exercise bar 20 to achieve a pose with the exercise bar 20 horizontal to ground. The exercise bar 20 acts as a measuring stick (ruler) to determine progress in one's own flexibility, and muscular strength.

Figure 16:
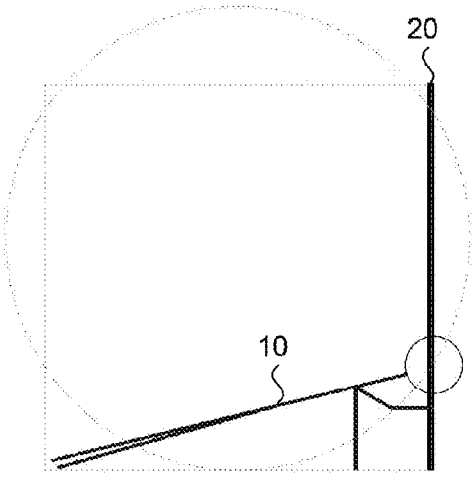

FIG. 16 is an illustration of use for the purpose of vertically supporting as a point of contact in the base of support while performing push-ups and one-handed planks. The base of support in this pose has 4 points of contact; feet, exercise bar 20 held in one hand, and opposite hand. Similar to a regular push up but with one hand holding exercise bar 20 vertically. As described in FIG. 13, there are many variations while holding exercise bar 20 vertically and positioning the entire human body 10 to resist the force of gravity.

Figure 17:
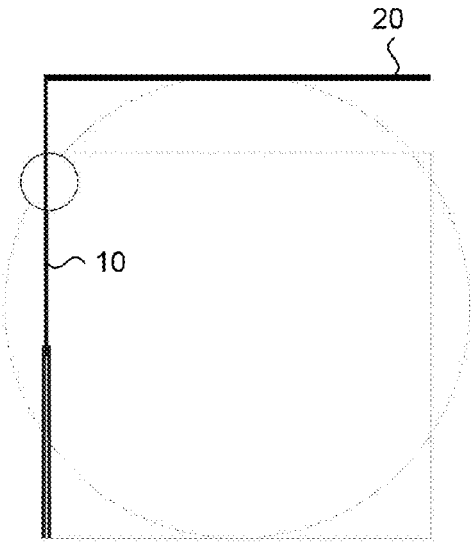

FIG. 17 is an illustration of use for the purpose of horizontally supporting against a wall as a point of contact in the pose. Stretching at full extension of the arms above head with hands holding on at one end of exercise bar 20 while the other end is against a wall. The wall is a horizontal support force pushing left and the feet are the frictional force from ground pushing toward the right to balance pose. Also pushing the exercise bar 20 against the wall will increases horizontal force to the left and the frictional force from ground pushing to the right requires core muscular strength, and other muscle groups throughout the body 10 from hands to feet to hold and balance.

Figure 18:
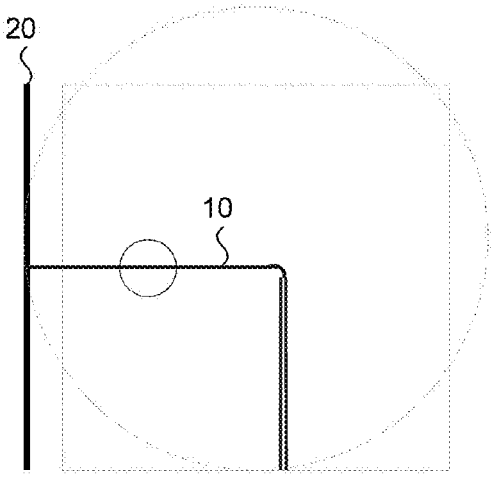

FIG. 18 is an illustration of use for the purpose of vertically supporting as a point of contact while bending forward keeping spine straight and back flat and pushing down with hands. Holding this pose increases flexibility and strength throughout the body 10 from hands to feet.

Figure 19:
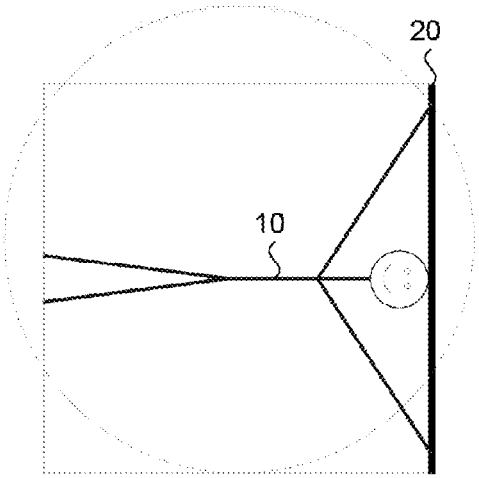

FIG. 19 is an illustration of use for the purpose to vertically supporting as one point of contact for the base of support on ground, while counter balancing the horizontal force of the wall with feet. The supporting force of the exercise bar 20 bares the force of gravity applied by the weight of the user and also the horizontal force of the wall to hold position.

Figure 20:
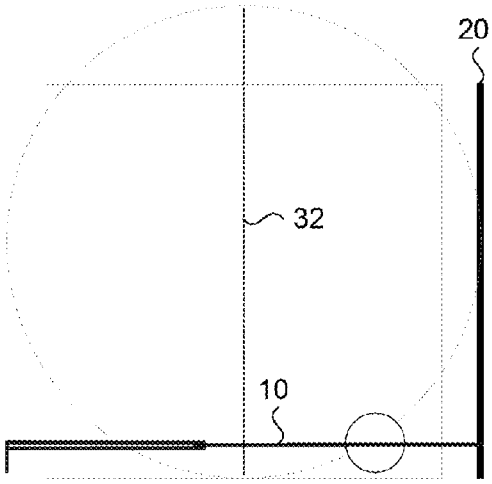

FIG. 20 is an illustration of FIG. 13 at maximum extension of legs and arms but with a greater force of gravity for the body 10 to resist and maintain pose. Performing this pose with one hand and one foot makes it more difficult by reducing points of contacts in the base of support. The dotted line 32 shows the center of gravity.

As previously discussed the exercise bar of the present embodiments should be sized to be close to the height of the person using it. For example, if the user is 5 feet and 9 inches tall, a 6-foot exercise bar (72 inch) is the required size. The exercise bar 20 should be at least the height of the user to achieve full range of positions and exercises it is intended for.

Figures 21A, 21B, 21C:
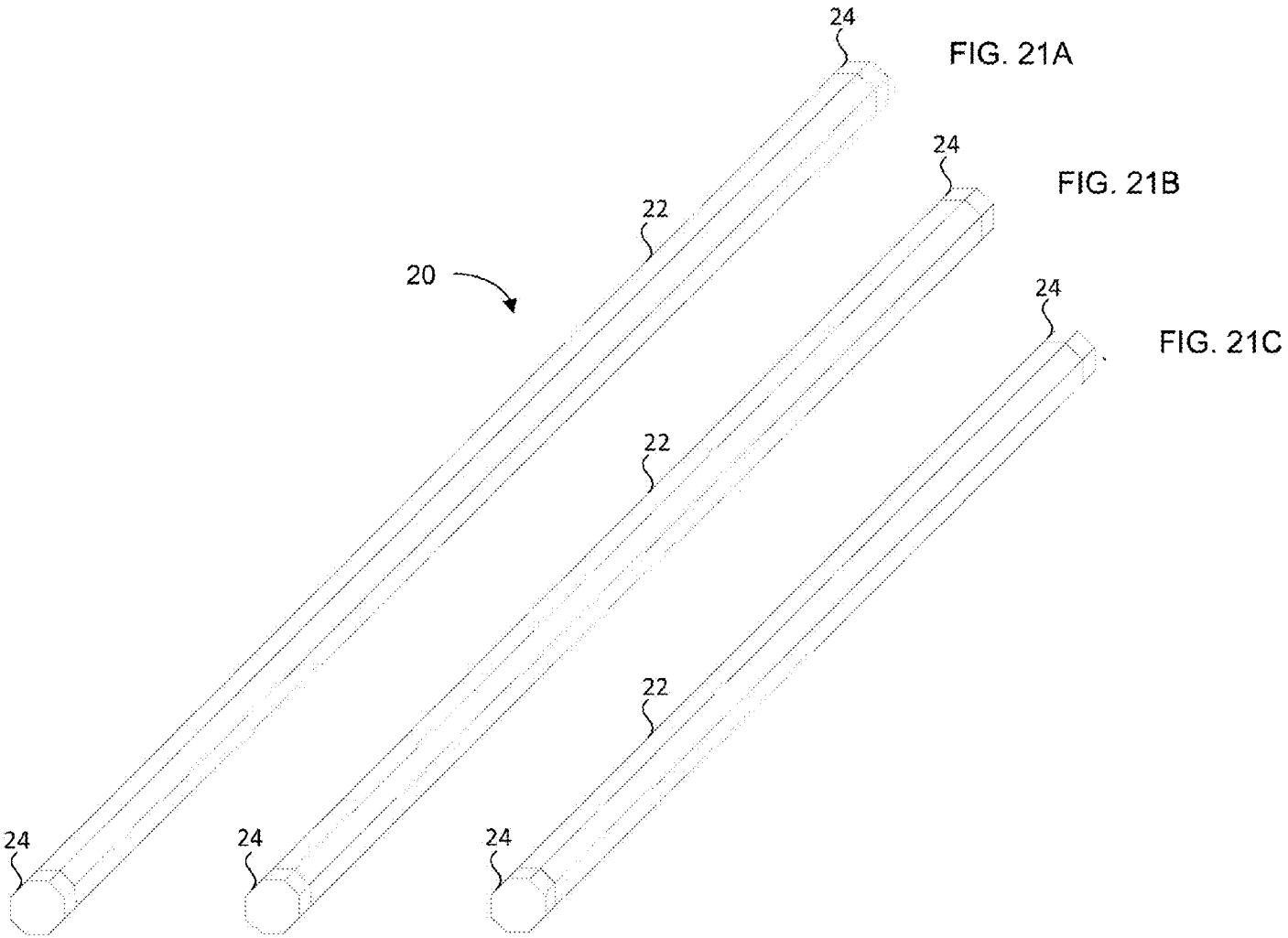
FIGS. 21A, 21B and 21C are perspective drawings of different example lengths of the exercise bar.
Figure 22A:
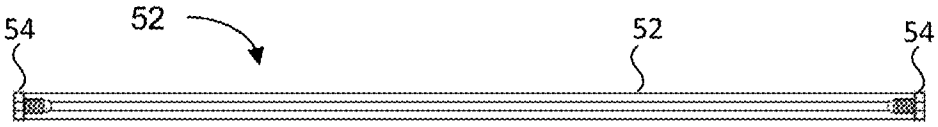
FIGS. 22A, 22B, 22C and 22D show side views of a different exercise bar with different lengths, according to an alternate embodiment.
Figure 22B:
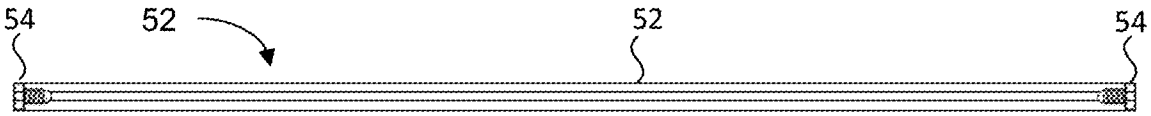
Figure 22C:
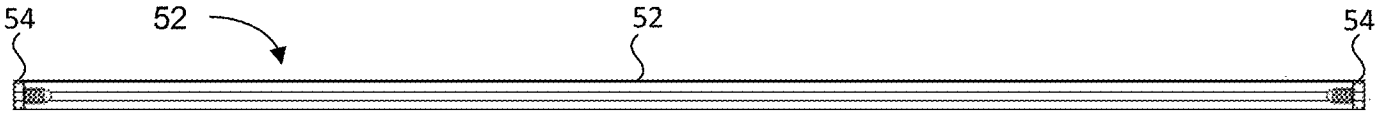
Figure 22D:
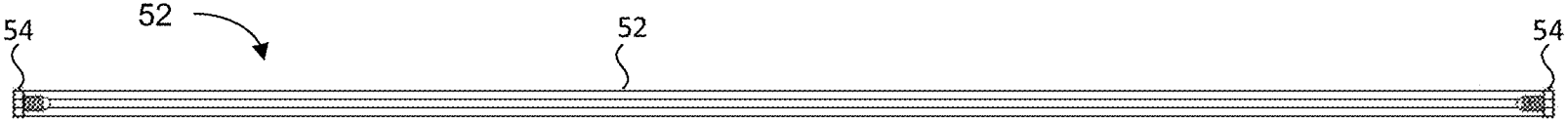

FIGS. 21A, 21B and 21C are perspective drawings of different example lengths the exercise bar 20 can be manufactured in. Each exercise bar 20 shown in FIGS. 21A, 21B and 21C includes a body 22 having both ends thereof terminated with stabilizer ends 24. The exercise bars 20 of FIGS. 21A, 21B and 21C are octagon in shape, as are the stabilizer ends 24, and have a diameter of 1.124 inches, in the present example.

FIGS. 22A to 22D shows side views of a different exercise bar with different lengths, according to an alternate embodiment. Exercise bars 50 are similar to previously shown exercise bars 20, and have a body 52 similar to previously described body 22. In the present embodiments, the ends of the body 22 have a threaded cavity (shown later) for receiving an alternate stabilizer end 54. The alternate stabilizer end 54 has a plug that is threaded to mate with the threads of the threaded cavity. Therefore, the stabilizer ends 54 can be rotated in one direction for installation in to the body 52 and rotated in an opposite direction for removal from the body 52.

Figure 23:
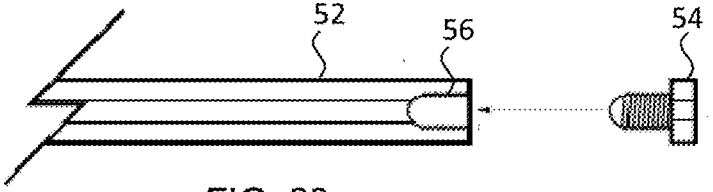
FIG. 23 shows a magnified view of a body end and a stabilizer end prior to installation.
Figure 25:
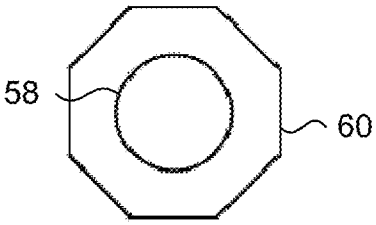
FIG. 25 shows a top face view of the stabilizer end of FIG. 23.
Figure 24:
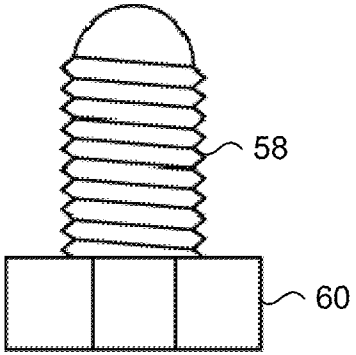
FIG. 24 is a side view of the stabilizer end of FIG. 23.

FIG. 23 shows a magnified view of an end of body 52, with stabilizer end 54 prior to installation. As shown in FIG. 23, the end of the body 52 has a threaded cavity 56, similar to the previously disclosed cylindrical cavity 26. The depth of the cylindrical cavity 26 can be at least the length of the plug of the stabilizer end. FIG. 24 is a side view of the stabilizer end 54, which clearly shows the base 58 and threaded plug 60 extending therefrom. FIG. 25 shows a top face view of stabilizer end 54, to illustrate the threaded plug 60 being centrally located on the base 58. The stabilizer end 54 can be manufactured or fabricated out of silicone. Similar to the embodiments shown in FIGS. 7 and 8, the stabilizer end 54 is manufactured of a malleable material, such as rubber, which allows the base 60 to flex and bend about the plug 58, and vice versa.

The previously described embodiments of the exercise bar 20 and 50 were shown as having a unitary body (22 or 52). This may not be practical for transportation or storage purposes. Furthermore, with fixed size bodies, it may not be practical or economical to manufacture bodies in too many lengths to try and accommodate all possible user heights. Therefore according to yet another alternate embodiment, an exercise bar having detachable locking segments is provided.

Figure 26:
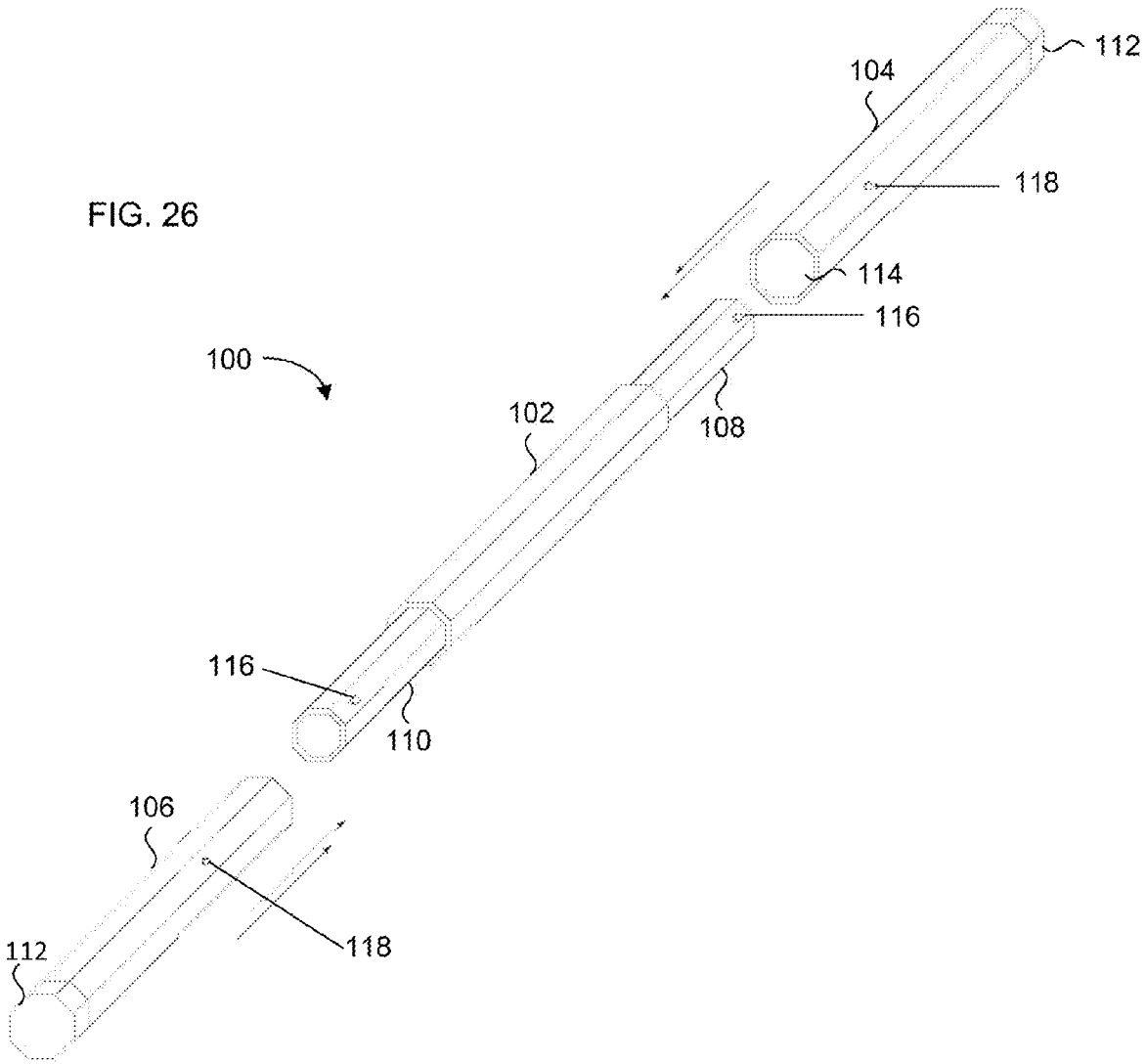
FIG. 26 shows a perspective view of a 3 segment exercise bar, according to another embodiment.

FIG. 26 shows a perspective view of a 3 segment exercise bar 100. The body includes a center body 102, a first end extension 104 and a second end extension 106. Generally, the center body 102, first and second end extensions 104 and 106 are octagon in shape and can have the same diameter as the previously described body embodiments. The center body 102 includes first and second reduced diameter arms 108 and 110 extending from the main body. Both first and second arms 108 and 110 can also be octagon in shape. Each of the first and second end extensions 104 and 106 has a portion opposite to the end terminated by stabilizer ends 112 that is hollow, and is thus configured as a sleeve 114 that is shaped for receiving either the first or second arms 108 and 110. The arms and the sleeves are dimensioned to result in a close fit when mated together such that there is minimal rotational movement and lateral movement relative to each other. The octagon shape of both parts further serves to minimize any rotation movement.

Formed on each arm 108 and 110 is at least one depressible clip plug 116. Formed in each sleeve 114 is a corresponding hole 118 to receive the depressible clip plug 116. The position of the hole 118 is set to correspond with the position of the clip plug 116, such that when the arm 108 is inserted into sleeve 116, the clip plug 116 will align and snap into hole 118. Clip plugs 116 are known in the art, and are biased to an extended position and depressible. For example, the clip plug 116 is first depressed to allow the arm 108 to initially be inserted into sleeve 114. At this time the clip plug 116 remains held in the compressed form due to the impinging inner walls of the first or second extensions 104 or 106. Upon alignment with the hold 118, the compressed clip plug 116 expands and the first or second extension is locked to the center body 102.

To unlock and disassemble the exercise bar, the clip plug 116 is depressed while gently sliding the first or second extensions 104 or 106 apart from the center body 102. Eventually the top of the clip plug 116 clears the hole 118 and both sections slide apart. While the present embodiment shows a single clip plug 116 formed on the arms, any number of clip plugs can be used. Furthermore, corresponding holes 118 can be formed in sleeve 114 to accommodate the clip plugs 116. The positions of the clip plugs can be placed at the same position on each face of the arm, or they can be placed at different positions to form a "keyed" pattern for which there is only one way to lock the arm to each extension.

One advantage of having a segmented body is the ability to mix and match different end extensions with the center body 102 to provide different length exercise bars.

Figure 27A:
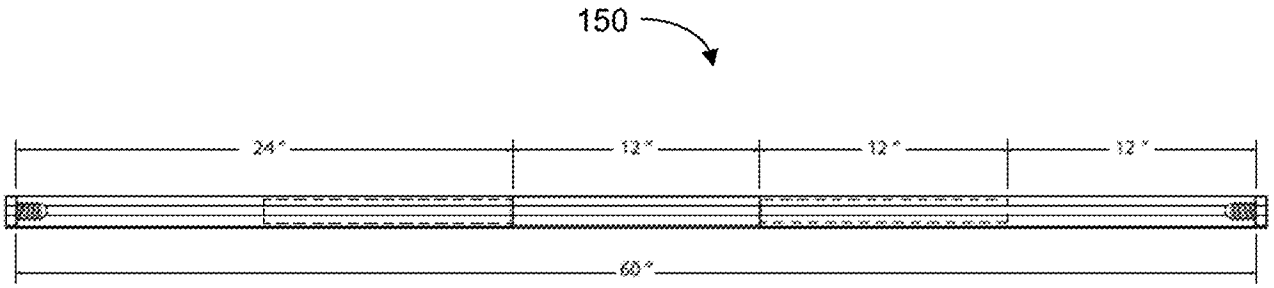
FIGS. 27A, 27B and 27C shows an example 5 foot exercise bar having 3 segments, according to one embodiment.
Figure 27B:
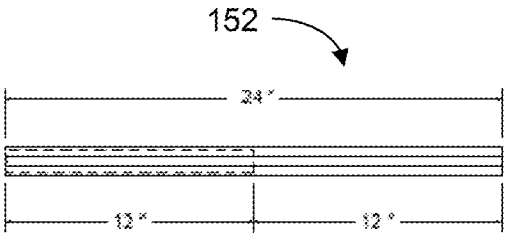
Figure 27C:
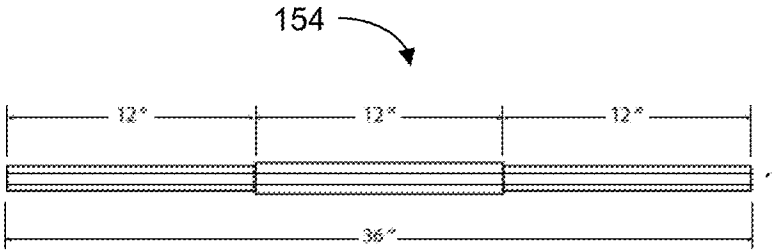

FIGS. 27A, 27B and 27C shows an example of a 5 foot exercise bar having 3 segments, based on the embodiment shown in FIG. 26. FIG. 27A shows the entire assembled exercise bar 150. FIG. 27B shows one of the two end extensions 152, each about 24 inches in length. The dashed line indicates the position of the sleeve cavity. FIG. 27C shows the center body 154 having a main body 12 inches in length, and two arms each 12 inches in length. The dashed lines shown in the end extensions 152 illustrate the sleeve portion thereof that receives the arm of the center body 152.

Figure 28A:
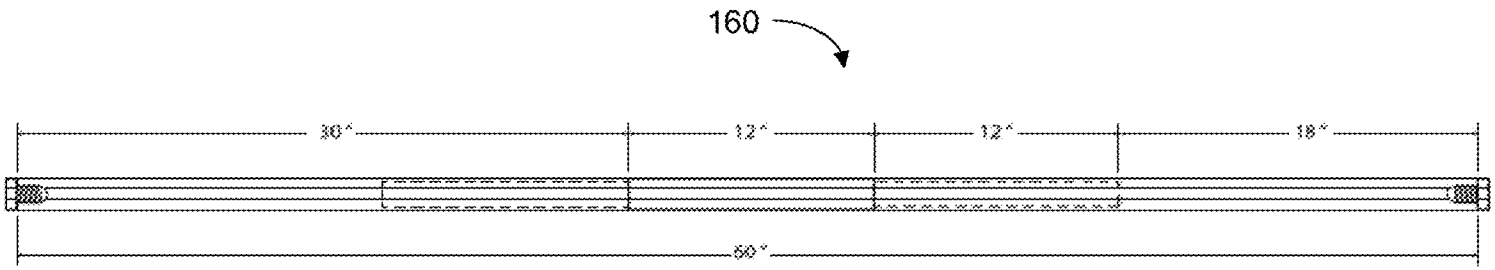
FIGS. 28A, 28B and 28C shows an example 6 foot exercise bar having 3 segments, according to one embodiment.
Figure 28B:
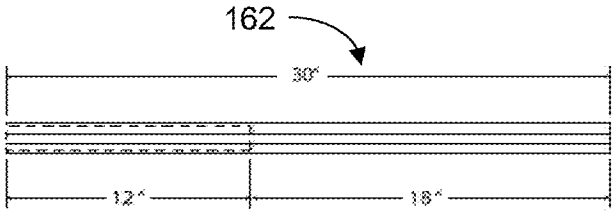
Figure 28C:
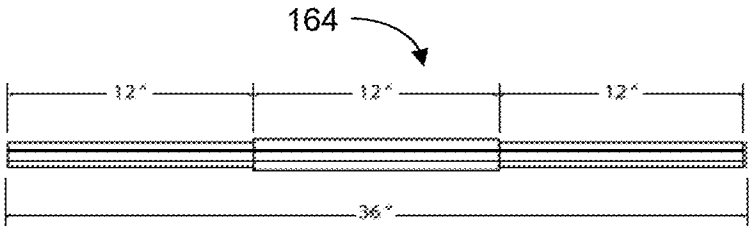

FIGS. 28A, 28B and 28C shows an example of a 6 foot exercise bar having 3 segments, based on the embodiment shown in FIG. 26. FIG. 28A shows the entire assembled exercise bar 160. FIG. 28B shows one of the two end extensions 162, each about 30 inches in length. The dashed line indicates the position of the sleeve cavity. FIG. 28C shows the center body 164 having a main body 12 inches in length, and two arms each 12 inches in length.

Figure 29A:
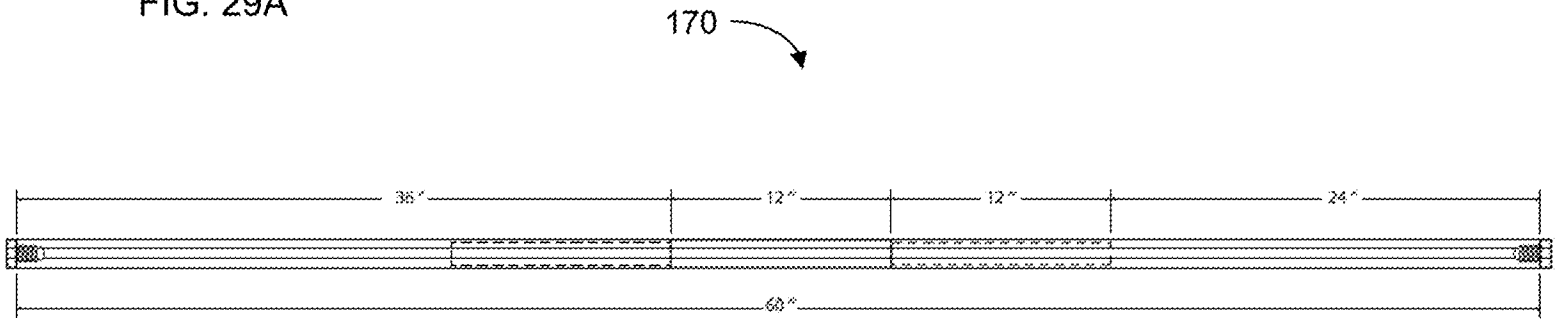
FIGS. 29A, 29B and 29C shows an example 7 foot exercise bar having 3 segments, according to one embodiment.
Figure 29B:
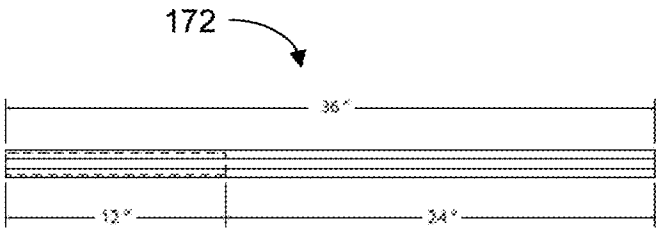
Figure 29C:
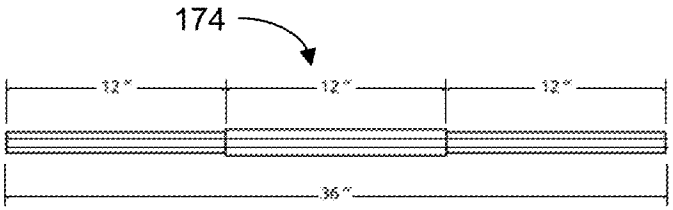

FIGS. 29A, 29B and 29C shows an example of a 7 foot exercise bar having 3 segments, based on the embodiment shown in FIG. 26. FIG. 29A shows the entire assembled exercise bar 170. FIG. 29B shows one of the two end extensions 172, each about 36 inches in length. The dashed line indicates the position of the sleeve cavity. FIG. 29C shows the center body 174 having a main body 12 inches in length, and two arms each 12 inches in length.

In these embodiments, the center body remains the same size, but the end extensions can vary in size between 24, 30 and 36 inches, by example. Different sizes of end extensions can be provided so that for any center body, different sized end extensions can be attached to each arm.

In these embodiments, the arm length is 12 inches. This length ensures that the segments will not inadvertently separate under any torsional force when they are assembled together. Alternately, any dimensioning designed to prevent inadvertent separation of the segments under torsional force can be used.

The 3 segment embodiment of the exercise bar can be used in the exercises shown in FIGS. 11-20 in place of the unitary exercise bar.

Figure 30:
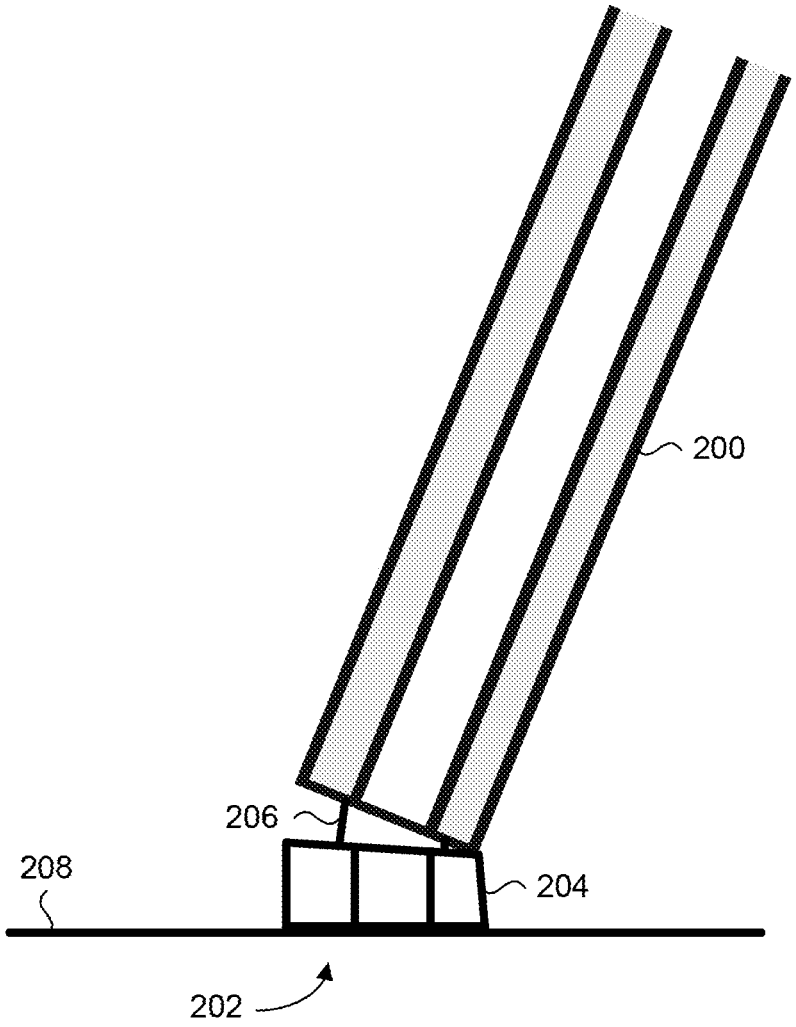
FIG. 30 shows an end of the exercise bar in use.

FIG. 30 is a drawing showing an end portion of the exercise bar of any of the previously described embodiments in use upon a floor surface. As shown in FIG. 30, longitudinal body 200 has a stabilizer end 202. The stabilizer end 202 has a base 204 and a plug 206, which is shown partially exposed in FIG. 30. In FIG. 30, the longitudinal body 200 is pushed down at an angle by a user relative to a floor surface 208. Because the faces of the base 204 and the end of the body 200 are not attached to each other, substantially the full outer face of base 204 remains in contact with the floor surface 208 while a gap or space forms between the end of the body 200 and an inside face of the base 204. This maximizes friction with the floor surface 208 for increasing the effectiveness of exercises in which the body 200 is angled relative to the floor surface 208. Furthermore, the base 204 may compress due to the edge of the body 200 pushing down upon it. The plug 206 while attached to the cavity (not shown) of the body 200, may stretch and bend as the body 200 is angled towards the floor surface 208. It is noted that FIG. 30 is not shown to scale and the actual compression of the base 204 and angle of the body 200 may differ in use.

The above-described embodiments are intended to be examples only. Alterations, modifications and variations can be effected to the particular embodiments by those of skill in the art without departing from the scope, which is defined solely by the claims appended hereto.

What is claimed is:

1. A hand held exercise tool having a predetermined length to guide and balance a user through exercises and positions, where the user's own natural body shape, weight and motion provides resistance to working muscles, the hand held exercise tool comprising:

an octagon shaped longitudinal body having a central axis and a predetermined diameter, the longitudinal body having a first end with a cavity, and a second end; and a stabilizer end attached to the first end of the longitudinal body, the stabilizer end being constructed of a material that minimizes slippage of the longitudinal body when placed on a surface, wherein the stabilizer end includes:

a plug inserted and secured in the cavity of the first end, a base flexibly attached to the plug and having a diameter approximately the same as the predetermined diameter of the longitudinal body, wherein the base has an inside face that is not attached to the first end of the longitudinal body, and is compressible when an outer face of the base is placed on the surface and an edge of the first end of the longitudinal body pushes against the inside face of the base, and a space forms between the inside face and the first end at an opposing edge of the first end, thereby enabling the longitudinal body to flex and bend about the base while the outer face of the base maintains contact with the surface.

2. The hand held exercise tool of claim 1, wherein the predetermined diameter is sized to allow a hand of the user to encircle the longitudinal body.

3. The hand held exercise tool of claim 2, wherein the predetermined diameter is approximately 1.125 inches.

4. The hand held exercise tool of claim 1, wherein the longitudinal body is coated with a synthetic coating to increase friction with a hand of the user.

5. The hand held exercise tool of claim 1, wherein the base of the stabilizer end is octagon in shape and the faces of the base align with faces of the longitudinal body when the stabilizer end is attached to the longitudinal body.

6. The hand held exercise tool of claim 5, wherein the cavity of the stabilizer end is sized to retain the plug by friction.

7. The hand held exercise tool of claim 6, wherein the cavity is threaded, and the plug has a complementary threading for enabling the stabilizer end to be screwed into the threaded cavity.

8. The hand held exercise tool of claim 1, wherein the longitudinal body is composed of three removably attachable segments.

9. The hand held exercise tool of claim 8, wherein a first segment is a main body having first and second octagon shaped, reduced diameter arms extending from respective ends of the main body, a second segment is a first end extension including the stabilizer end, and includes a hollow sleeve portion shaped to receive one of the reduced diameter arms of the main body, and a third segment is a second end extension, and includes a hollow sleeve portion shaped to receive the other of the reduced diameter arms of the main body.

10. The hand held exercise tool of claim 9, wherein the reduced diameter arms each include at least one depressible clip plug, and the hollow sleeve portions of each of the second segment and the third segment include at least one hole positioned to receive a respective clip plug, the second segment and the third segment locking with the first segment when the clip plugs engage the holes.

11. The hand held exercise tool of claim 10, wherein lengths of the second segment and the third segment are identical to each other.

12. The hand held exercise tool of claim 10, wherein lengths of the second segment and the third segment are different from each other.

13. The hand held exercise tool of claim 1, further including a second stabilizer end attached to the second end of the longitudinal body, the second stabilizer end being constructed of a material that minimizes slippage of the longitudinal body when placed on the surface, wherein the second stabilizer end includes:

a second plug inserted and secured in a cavity of the second end of the longitudinal body, a second base attached to the second plug and having a diameter approximately the same as the predetermined diameter of the longitudinal body, wherein the second base has an inside face that is not attached to the second end of the longitudinal body, and is compressible when an outer face of the second base is placed on the surface and an edge of the second end of the longitudinal body pushes against the inside face of the second base, and a space forms between the inside face of the second base and the second end at an opposing edge of the second end.

* * * * *